US005540054A

United States Patent [19]

Bullivant

[11] Patent Number: 5,540,054

[45] Date of Patent: Jul. 30, 1996

[54] ENGINE ROTARY VALVES

[76] Inventor: Nicholas T. Bullivant, Box Bush, Upper Redbrook, Monmouth, Gwent, Wales, United Kingdom, NP5 4LU

[21] Appl. No.: 204,182

[22] Filed: Sep. 21, 1994

Related U.S. Application Data

[63] Continuation of PCT/GB92/01520, Aug. 18, 1992.

[30] Foreign Application Priority Data

Sep. 5, 1991 [GB] United Kingdom ..... 9118944

[51] Int. Cl.[6] ..... F02B 33/00; F01L 7/02

[52] U.S. Cl. ..... 60/598; 123/190.8; 123/559.1; 60/605.1

[58] Field of Search ..... 60/597, 598, 605.1; 123/79 R, 80 R, 190.8, 559.1

[56] References Cited

U.S. PATENT DOCUMENTS

| | | | |
|---|---|---|---|
| 1,311,200 | 7/1919 | Abell | 123/79 R |
| 1,443,110 | 1/1923 | Abell | 123/79 R |
| 2,888,800 | 6/1959 | Densham | 60/597 |
| 4,134,381 | 1/1979 | Little . | |
| 4,815,428 | 3/1989 | Bunk | 123/190.8 |
| 5,003,942 | 4/1991 | Hansard | 60/598 |

FOREIGN PATENT DOCUMENTS

| | | |
|---|---|---|
| 2393934 | 1/1979 | France . |
| 1552564 | 9/1979 | United Kingdom . |
| 2203192 | 10/1988 | United Kingdom . |

*Primary Examiner*—Michael Koczo

[57] ABSTRACT

A rotary valve for an engine comprising an outer casing 2 having at least one bore 4, inlet port 30, exhaust port 46 and transfer duct 44 opening into the bore 4 or bores, at least one vaned rotor 26 disposed in the bore 4 or bores, and popper valve means 54 for admitting an inlet charge from the inlet manifold to the transfer duct 44 or one of the transfer ducts into the cylinder of the engine and for venting exhaust gases from the cylinder of the engine into the transfer duct 44 or one of the transfer ducts to the exhaust manifold of the engine, and porting means 8 for placing the inlet port 30 in fluid communication with the transfer duct 44 or one of the transfer ducts to supply an inlet charge thereto and for placing the exhaust port 46 in fluid communication with the transfer duct 44 or one of the transfer ducts for venting of exhaust gases, wherein the vaned rotor 26 is adapted to be rotated by the vented exhaust gases and to compress the inlet charge as a result of such rotation.

2 Claims, 3 Drawing Sheets

ENGINE ROTARY VALVES

This application is a continuation of application number PCT/GB92/01520 filed on 18 Aug. 1992, which designated the USA, and so claims the benefit of 35 USC 120, and also claims benefit under 35 USC 119 of application GB 9118944-9 filed on 5 Sep. 1991.

This invention relates to rotary valves for engines and is concerned more particularly, but not exclusively, with rotary valves for internal combustion engines.

WO 91/10814 discloses a three-way rotary valve to control the inlet and exhaust of an internal combustion engine. Such a valve has an outer sleeve member rotatable within a bore in an outer casing and having inlet, exhaust and admission ports registrable with corresponding inlet, exhaust and admission ports in the outer casing during the induction, compression, ignition and exhaust cycles of the associated engine cylinder. In addition an inner deflector member is rotatable within the outer sleeve member in the opposite direction to the direction of rotation of the outer sleeve member so that, in a first relative position of the valve members, the valve members define a first passage placing the inlet port in fluid communication with the admission port, and, in a second relative position of the valve members, the valve members define a second passage placing the admission port in fluid communication with the exhaust port. Whilst such a rotary valve operates satisfactorily in many applications, there are certain applications in which the compression rate of the inlet charge and the purge rate of the exhaust gases will be insufficient.

It is an object of the invention to provide a rotary valve of increased performance.

According to the present invention there is provided a rotary valve for an engine comprising an outer casing having at least one bore, inlet, exhaust port and transfer duct opening into the bore or bores, at least one vaned rotor disposed in the bore or bores, and popper valve means for admitting an inlet charge from the inlet manifold to the transfer duct or one of the transfer ducts into the cylinder of the engine and for venting exhaust gases from the cylinder of the engine into the transfer duct or one of the transfer ducts to the exhaust manifold of the engine, and porting means for placing the inlet port in fluid communication with the transfer duct or one of the transfer ducts to supply an inlet charge thereto and for placing the exhaust port in fluid communication with the transfer duct or one of the transfer ducts for venting of exhaust gases, wherein the vaned rotor is adapted to be rotated by the vented exhaust gases and to compress the inlet charge as a result of such rotation.

Such an arrangement is particularly advantageous as it absorbs waste pressure during the exhaust cycle as well as using the rotation of the vaned rotor to compress the inlet charge during the induction cycle. The resulting flow of cool air through the rotor will overcome many of the problems with heat soak and heat detreating, which leads to efficiency losses as well as short rotor life as is common with high performance turbo charged engines. Furthermore, with the rotor assembly being in such close proximity to the cylinder of the engine, the vaned rotor will also serve to scavenge the combustion chamber at the end of the exhaust stroke.

In a first embodiment of the invention, the poppet valve means comprises a single popper valve for admitting the inlet charge to the engine and for venting exhaust gases from the engine by way of a common transfer duct, and the porting means is adapted to selectively place the transfer duct in fluid communication with the inlet and exhaust ports by way of a common rotor.

In this case the porting means may comprise a rotatable inner sleeve surrounding the rotor within the bore and having a series of ports for selectively placing the transfer duct in fluid communication with the inlet and exhaust ports in dependence on the rotational position of the sleeve.

The valve may also include an outer sleeve surrounding the rotor within the bore and rotatably or axially movable to adjust the through flow cross-section of one or more of the ports.

In a second embodiment of the invention, the poppet valve means comprises separate poppet valves for admitting the inlet charge to the engine and for venting exhaust gases from the engine by way of separate transfer ports and said at least one rotor preferably comprises an impeller part for rotation by the vented exhaust gases and a compressor part for compression of the inlet charge, the impeller and compressor parts being accommodated within separate chambers.

Such an arrangement is particularly advantageous for use as a turbocharger as it avoids many of the problems associated with conventional turbochargers.

It is preferred that such an arrangement includes cooling means for drawing off air supplied to the compressor chamber and for supplying the drawn off air to the impeller chamber to cool the impeller. The cooling means may include valve means for drawing off air in response to increase of the pressure in the compressor chamber above a first threshold valve, and for supplying air in response to decrease of the pressure in the impeller chamber below a second threshold valve.

The invention also provides a turbocharger comprising an impeller chamber, an impeller disposed within the impeller chamber and rotatable by exhaust gases vented from an engine, a compressor chamber, a compressor disposed within the compressor chamber and driven by the impeller to compress an inlet charge to an engine, and cooling means for supplying cooling air from the compressor chamber to the impeller chamber to cool the impeller.

In order that the invention may be more fully understood, embodiments of rotary valve according to the invention will now be described, by way of example, with reference to the accompanying drawings, in which.

Figure 1:
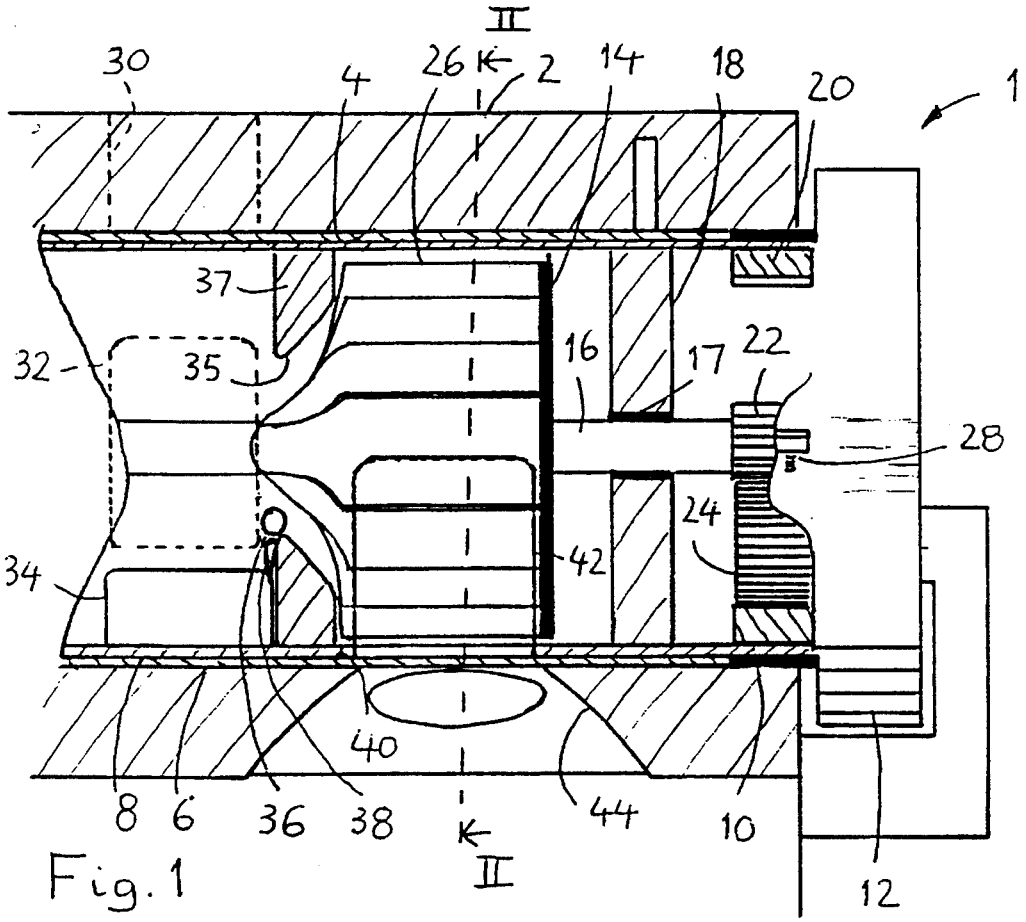
FIG. 1 is a side view of a first rotary valve partly in section.

Referring to FIG. 1, the rotary valve 1 comprises an outer casing 2 which may form part of the cylinder head of an engine. The outer casing 2 is formed with a cylindrical bore 4 within which are rotatably disposed an outer sleeve 6 and an inner sleeve 8. The inner sleeve 8 is journalled within annular bearings 10 provided at the two ends of the sleeve 8, and is integral with an outer gear wheel 12 outside the bore 4 by means of which the inner sleeve 8 is rotatable by suitable drive means.

In addition an inner rotor 14 is disposed within the inner sleeve 8 and is mounted on a rotatable shaft 16 journalled within bearings 17 in partition walls 18 fixed in the inner sleeve 8. The inner sleeve 8 also has an inner annular gear 20 which drives a gear wheel 22 provided on the shaft 16 by way of an idler gear 24. The rotor 14 comprises a multi-bladed impeller 26 which is designed to optimize exhaust venting, induction compression and fuel/air mixing during rotation as will be described in more detail below, and a ratchet 28 coupling the shaft 16 to the gear wheel 22 permits decoupling of the impeller 26 from the inner sleeve 8 to allow the impeller 26 to spin freely when the speed of the exhaust gases acting on the impeller 26 exceeds the speed at which the impeller 26 is driven. Instead of being driven by the gear arrangement as shown, the impeller 26 may alternatively be driven by an electric motor or by a belt driven by the crankshaft, or alternatively drive may be provided solely by the exhaust gases.

The outer casing 2 is provided with an inlet port 30, shown in broken lines, which extends around a portion of the outer casing's circumference, and an inlet port 32, also shown in broken lines, is provided in the outer sleeve 6 and is normally in register with the inlet port 30. Furthermore, an inlet port 34 in the inner sleeve 8 is brought into register with the inlet port 30 byway of the inlet port 32 at an appropriate point in each rotation of the inner sleeve 8 corresponding to the induction cycle. Air entering the inlet port 34 is conducted radially inwardly of the inner sleeve 8 and passes axially of the impeller 26 through a coaxial aperture 35 in a partition wall 37 together with a charge of fuel introduced by a fuel injector nozzle 36 in the wall of the outer casing 2 by registering of a slot 38 in the inner sleeve 8 with the nozzle 36, and a corresponding aperture in the outer sleeve 6. It should be appreciated that rotation of the inner sleeve 8 itself controls supply of fuel from the fuel injector nozzle 36, and that the length and shape of the slot 38 is used to control the fuel flow. For example, a wedge-shaped slot can be used to produce a progressive increase or decrease in the flow of fuel during the induction cycle, the fuel supply being effected by a solenoid valve operated by a microswitch or a pin-operated mechanical valve. The fuel and air are then subjected to turbulent mixing by rotation of the impeller 26. At the same time a transfer port 40 in the inner sleeve 8 is in register with a transfer port 42 in the outer sleeve 6 and a transfer duct 44 in the outer casing 2 opening into the cylinder.

The operation of the rotary valve will now be further described with reference to FIGS. 2 to 5 showing cross-sections of the valve in the vicinity of the impeller 26 during the induction, compression, ignition and exhaust cycles respectively. As will be appreciated from referring to these figures there is additionally an exhaust port 46 in the outer casing 2 which is communicable with the transfer port 40 in the inner sleeve 8 by way of an exhaust port 48 in the outer sleeve 6. Furthermore the transfer duct 44 communicates with the cylinder 50 by way of a cylinder port 52 which is selectively closed by a poppet valve member 54 actuated by the cam shaft 56, The inner sleeve 8 and the cam shaft 56 are rotated with the required relative timings so as to enable the following sequence of operations to be performed with the inner sleeve 8 rotating anti-clockwise and the impeller 26 rotating clockwise as shown in FIGS. 2 to 5.

Figure 2:
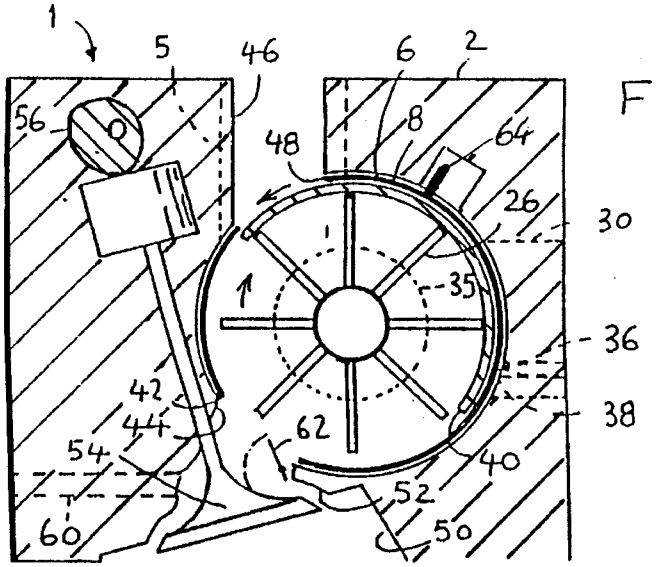

In the induction cycle, as shown in FIG. 2, the inner sleeve 8 is in a position such that the transfer port 40 is in register with the transfer duct 44, and at the same time air and fuel are admitted to the valve and passed axially through the aperture 35 along the impeller 26 as previously described, with the result that the fuel and air are mixed by rotation of the impeller 26 and the fuel/air mixture is supplied to the cylinder 50 by way of the transfer duct 44, the cylinder port 52 being maintained open by the poppet valve member 54 during this cycle. In the illustrated embodiment the inner sleeve 8 is rotated at half the speed of the crankshaft. However, in arrangements in which the inner sleeve is rotated at a lower speed with respect to the crankshaft, it would be necessary to arrange for a corresponding increase in the circumferential extent of the transfer port 40.

Figure 3:
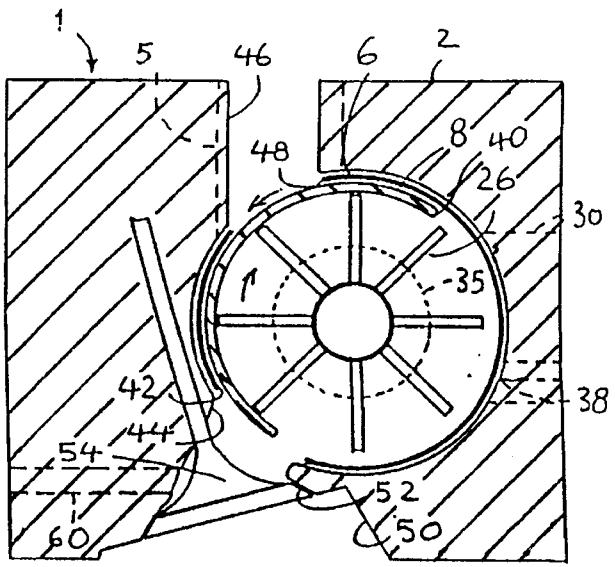
FIGS. 2 to 5 are cross-sectional views of the first rotary valve taken along the line II—II in FIG. 1, respectively mid-way through the induction, compression, ignition and exhaust cycles.
Figure 4:
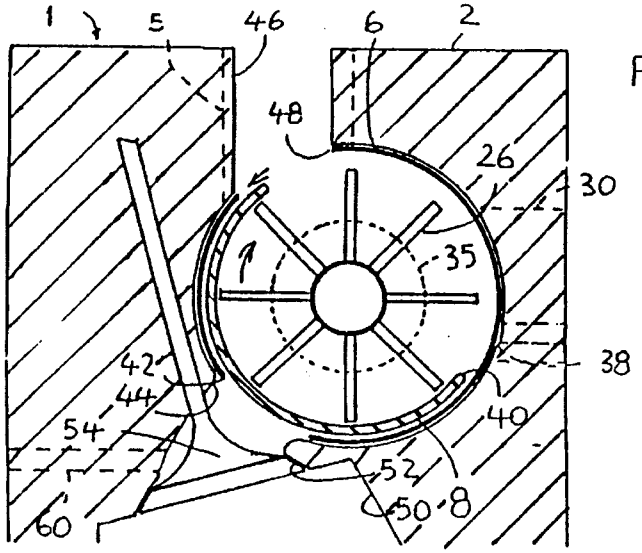

At the end of the induction cycle, the cam shaft 56 causes the popper valve member 54 to close the cylinder port 52 and the compression cycle begins. As shown in FIG. 3, the inner sleeve 8 rotates to close off the transfer duct 44. Rotation of the inner sleeve 8 will previously have cut off supply of fuel from the fuel injector nozzle 36, although supply of air through the inlet port 34 may continue until the inner sleeve 8 has opened up the exhaust port 46 in the compression and ignition cycle, as shown in FIG. 4. This allows air to be blown out through the exhaust port 46 by rotation of the impeller 26, thus cooling the internal components and helping to burn any unburned fuel in the exhaust manifold. The inlet port 34 in the inner sleeve 8 may be arranged to come into fluid communication with a purge port 56, shown in broken lines in FIGS. 2 to 5, to allow the flow of air to the exhaust port 46 to continue even after the throttle has been closed.

Figure 5:
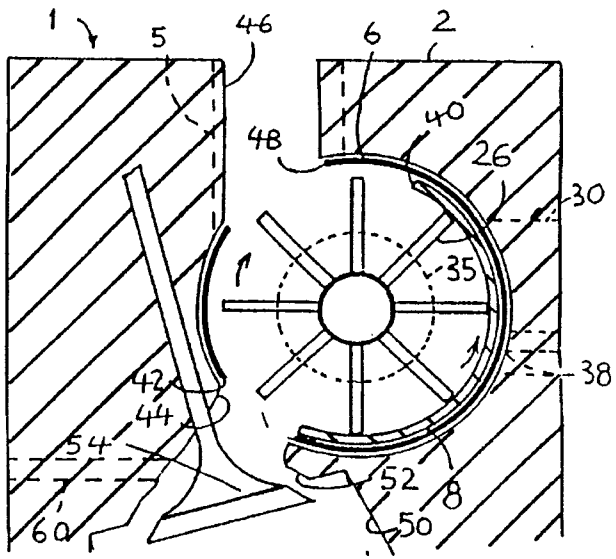

At the end of the ignition cycle the inner sleeve 8 rotates to a position as shown in FIG. 5 in which the transfer port 40 places the transfer duct 44 in fluid communication with the exhaust port 46. When the poppet valve member 54 opens the cylinder port 52 in the exhaust cycle, exhaust gas is discharged at speed, thus accelerating the impeller 26. As the piston within the cylinder 50 slows to a halt, the impeller 26 will sweep the transfer duct 44 and the cylinder 50 clear of gas, although it may additionally be necessary to provide a purge valve in the combustion chamber to completely vent the combustion chamber of all exhaust gases. If required a flow deflector 62, as shown in FIG. 2, which is deflectable by gas flow may be put in the transfer duct 44 to concentrate the flow of exhaust gases towards the part of the impeller 26 which will ensure most efficient spinning of the impeller 26.

A valved pressure relief port 60 may be used to stop the cylinder 50 over-pressurising during induction. The pressure relief valve used may be in the form of a pop-off valve or a pressure-switch for supplying a signal to the engine management system to reduce the inlet flow by rotation of the outer sleeve 6 in a manner which will be described in more detail below. If required, braking of the impeller 26 may be effected in response to such signalling by a magnetic braking system or by the back e.m.f. of an electric motor.

The function of the outer sleeve 6 is to permit the through flow cross-sections of the air inlet 30, the transfer duct 44 and the exhaust outlet 46 to be varied by limited rotation of the outer sleeve 6 relative to the outer casing 2. Additionally or alternatively the outer sleeve 6 may be moved axially relative to the outer casing 2 to effect such adjustment. Furthermore, adjustment of the outer sleeve 6 may be effected during operation by an adjusting mechanism 64, see FIG. 2, operated by a vacuum or compressed air operated throttle or by a servomotor which is connected to the engine management system. Thus the gas velocity through the ports may be increased at low engine speed to increase torque.

The illustrated valve has been described above as forming part of a purpose built cylinder head. However the valve may also be adapted to be fitted to one or more of the inlet/outlet ports of a conventional engine. In this case the camshaft for the main gas flow could be re-profiled to open for the exhaust and induction cycles and to close for the compression and ignition cycles. The second popper valve or valves would then open momentarily at the end of the exhaust cycle and at the beginning of the induction cycle. This would allow the incoming charge to purge the transfer duct and combustion chamber of any exhaust gas. In the case of a multi-valve engine, the inner rotor could be sub-divided into as many sections as there are valves, and these could then be tuned to maximise flow through the engine.

Figure 6:
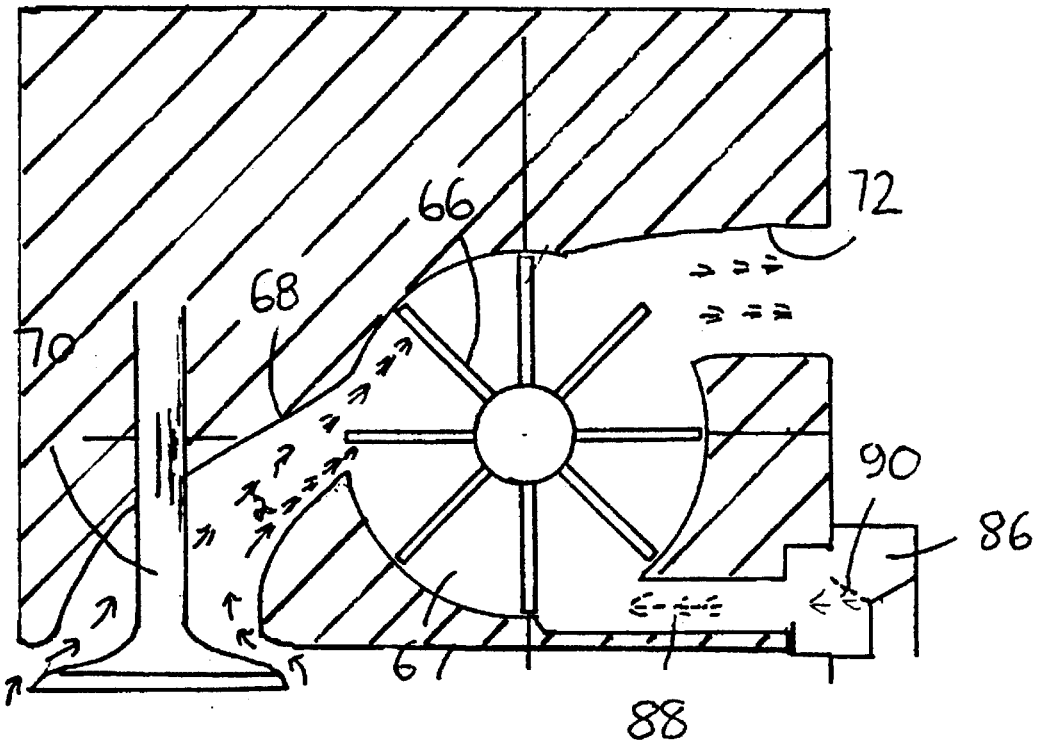
FIGS. 6 and 7 are diagrammatic cross-sections of parts of a second rotary valve.
Figure 7:
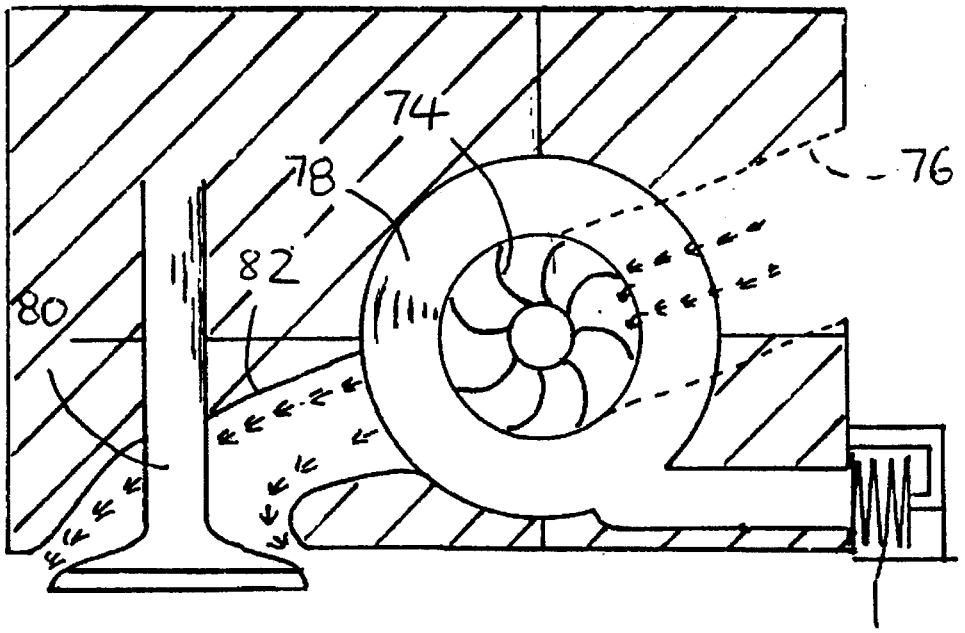

A further rotary valve, for use as a turbocharger will now be described with reference to FIGS. 6, 7 and 8. In this case the valve has an impeller 66 within a chamber 67 which is driven by exhaust gases vented along an exhaust duct 68 on opening of an exhaust popper valve 70, as shown in FIG. 6. The exhaust gases are then vented through an exhaust port 72. A separate air compressor 74, which may be provided on a common shaft to the impeller 66 or which may be coupled thereto by an appropriate drive mechanism, is provided within a chamber 78, as shown in FIG. 7, and is driven by the impeller 66 so as to compress air drawn through an inlet port 76 which is axially offset relative to the compressor 74 to permit the air to be supplied in the axial direction of the compressor 74, in a similar manner to the arrangement described with reference to FIG. 1. The supplied air, to which fuel may be added in the manner described with reference to FIG. 1, is compressed within the chamber 78 until an inlet popper valve 80 opens to permit supply of the air or the fuel/air mixture along an admission duct 82 into the engine cylinder. When the pressure in the chamber 78 reaches a predetermined level a pop-off valve 84 opens to admit air into a bypass cavity 86, see FIG. 6, from which cooling air may be supplied to the chamber 67 by way of a cooling port 88 on opening of a cooling vent 90.

Referring to FIG. 6, when the exhaust valve 70 opens, and the piston within the cylinder decelerates, the venting exhaust gases spin the impeller 66, and, when the piston slows to a halt, the impeller 66 serves to suck the remaining exhaust gases out of the cylinder, thus overcoming any back pressure due to constriction of the exhaust gas flow. When the exhaust valve 70 subsequently closes, the pressure in the chamber 67 is reduced and this causes opening of the cooling vent 90, which comprises a reed-type valve, to permit cooling air to enter the chamber 67 to cool the impeller 66 during the subsequent compression and ignition cycles. When the exhaust valve 70 subsequently opens, the resulting increase in pressure in the chamber 67 causes closing of the cooling vent 90 to prevent waste gas leakage.

Figure 8:
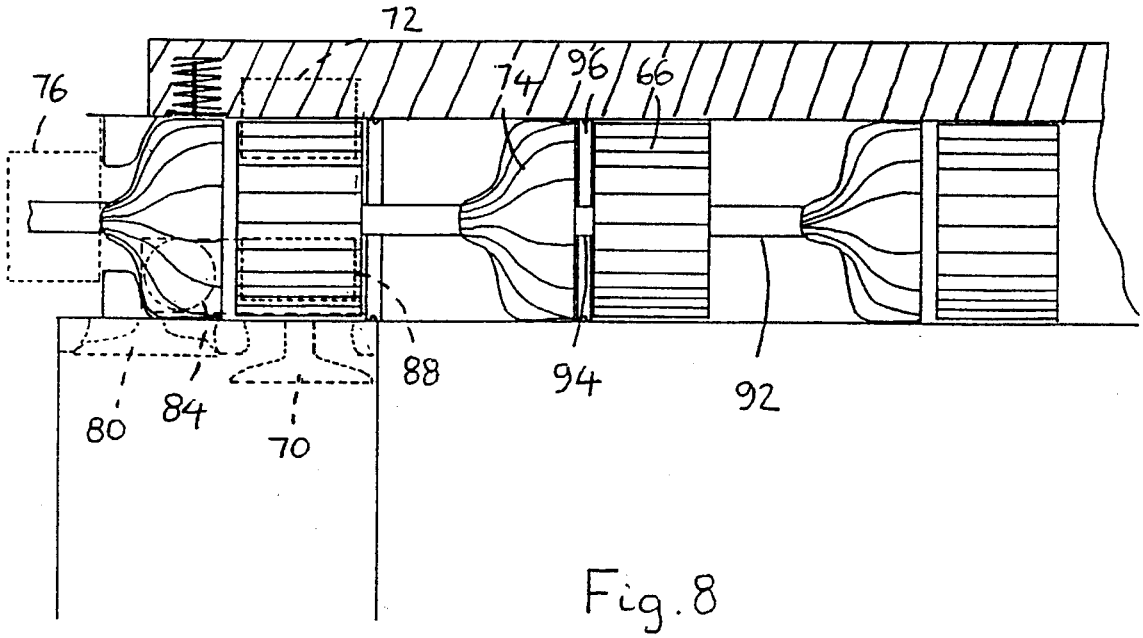
FIG. 8 is an axial section through the second rotary valve.

FIG. 8 shows the manner in which a number of impellers 66 and compressors 74 for venting/supplying a number of cylinders may be mounted in line on a common shaft 92 which is journalled in bearings 94 provided in thermally insulating partition walls 96. If required the number of impellets may be less than the number of compressors, although a minimum of one impeller will be required to drive a number of compressors. The complete turbocharger assembly can run the length of the cylinder head and can be built into or bolted on the outside of the head between the head and the exhaust manifold. Since the turbocharger is in such close proximity to the exhaust and inlet valves 70, 80, and a dedicated impeller can be provided for each exhaust valve, the exhaust gases can act directly on the impeller, thus substantially eliminating the well known problem of "turbo lag" caused by the time which it takes for exhaust gases to travel through the exhaust manifold pipes to the location of the turbine.

Furthermore, due to the supply of cooling air to the chamber 67 to cool the impeller 66, the ambient heat in the turbine is up to ten times less than in conventional arrangements, and thus the life expectancy of the impeller is considerably enhanced, particularly in high performance engines, and in addition exhaust turbine rubber seals can be used, The turbine can be driven from the crankshaft by a suitable drive train to maintain the speed of the turbine at low engine speed, if required, and this drive train may include a magnetic clutch, similar to that used in air conditioning units, which may be selectively actuated either manually or in response to throttle actuation or under the control of the engine management system, A ratchet may be provided to allow the turbine to freewheel if necessary.

I claim:

1. A rotary valve for an engine comprising an outer casing 2 having at least one bore 4, inlet port 30, exhaust port 46, and transfer duct 44 opening into the bore 4 or bores, at least one vaned rotor 26 disposed in the bore 4 or bores, and poppet valve means 54 for admitting an inlet charge from the inlet manifold to the transfer duct 44 or one of the transfer ducts into the cylinder of the engine and for venting exhaust gases from the cylinder of the engine into the transfer duct 44 or one of the transfer ducts to the exhaust manifold of the engine, and rotary valve means 8 for placing the inlet port 30 in fluid communication with the transfer duct 44 or one of the transfer ducts to supply an inlet charge thereto and for placing the exhaust port 46 in fluid communication with the transfer duct 44 or one of the transfer ducts for venting of exhaust gases, wherein the vaned rotor 26 is adapted to be rotated by the vented exhaust gases and to compress the inlet charge as a result of such rotation.

2. A rotary valve according to claim 1 comprising an outer sleeve 6 surrounding the rotary valve 8 within the bore 4 and rotatably or axially moveable to adjust the through flow cross-section of one or more of the ports.

* * * * *